US012642350B2

(12) United States Patent
Dirisala et al.

(10) Patent No.: US 12,642,350 B2
(45) Date of Patent: Jun. 2, 2026

(54) CABINET SYSTEM

(71) Applicant: WHIRLPOOL CORPORATION, Benton Harbor, MI (US)

(72) Inventors: Venkata S. Dirisala, Benton Harbor, MI (US); David P. Drabousky, Benton Harbor, MI (US); Joel D. Haselhuhn, Berrien Springs, MI (US); Amanda Schnipke, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 29 days.

(21) Appl. No.: 18/787,379

(22) Filed: Jul. 29, 2024

(65) Prior Publication Data

US 2026/0026617 A1 Jan. 29, 2026

(51) Int. Cl.
*A47B 57/20* (2006.01)
*A47B 47/00* (2006.01)

(52) U.S. Cl.
CPC ..... *A47B 57/20* (2013.01); *A47B 47/0075* (2013.01)

(58) Field of Classification Search
CPC . A47B 47/0075; A47B 47/021; A47B 47/024; A47B 47/025; A47B 57/08; A47B 57/10; A47B 57/16; A47B 57/20; A47B 57/22; A47B 57/48; A47B 57/482; A47B 96/02; A47B 96/021
See application file for complete search history.

(56) References Cited

U.S. PATENT DOCUMENTS 2,926,978 A * 3/1960 Mitchell ..... A47B 47/03 312/334.44
3,272,581 A * 9/1966 Stucki ..... A47B 88/43 312/265.5
3,819,245 A * 6/1974 Tacke ..... A47B 91/005 312/351.7
4,836,626 A 6/1989 Taylor et al.
5,399,010 A * 3/1995 McClung ..... E06B 3/5045 312/332
5,931,553 A 8/1999 Cohen
6,099,095 A * 8/2000 Irace ..... A47B 47/02 312/265.5

(Continued)

FOREIGN PATENT DOCUMENTS

CN 108937168 A * 12/2018 ..... A47B 47/025
CN 213640144 U 7/2021

(Continued)

OTHER PUBLICATIONS

Publication "Gladiator Manual 2010" @ 2010 to Whirlpool Corporation, and available at https://gladiator.manymanuals.com/storage-chests-cabinets-trunks/galg36ckxg/instruction-manual-33006/download.

*Primary Examiner* — Andrew Roersma
(74) *Attorney, Agent, or Firm* — McGarry Bair PC

(57) ABSTRACT

A cabinet system includes a cabinet defined by a back panel, top panel, bottom panel and first and second opposing side panels. Each of the side panels includes at least one slot for supporting at least one removable shelf. The at least one removable shelf includes tabs for engaging with the slots located on the side panels and a cut-out along a rear edge wherein the cut-out is configured to weaken the at least one removable shelf at a predetermined location to promote controlled deformation of the removable shelf.

20 Claims, 6 Drawing Sheets

(56) References Cited

U.S. PATENT DOCUMENTS

| | | | | |
|---|---|---|---|---|
| 6,399,172 | B1 * | 6/2002 | Carr | A47B 96/202 428/61 |
| 6,409,293 | B1 * | 6/2002 | Chang | A47B 88/941 312/265.5 |
| 6,561,601 | B1 | 5/2003 | Maffeo | |
| 6,942,306 | B2 * | 9/2005 | Youngs | A47B 57/404 312/263 |
| 7,866,770 | B2 * | 1/2011 | Wu | A47B 47/02 312/263 |
| 8,042,890 | B2 | 10/2011 | Collins et al. | |
| 8,172,344 | B2 * | 5/2012 | Eyer | E05F 1/006 312/351 |
| 8,240,786 | B2 * | 8/2012 | Daino | G06F 3/1268 312/324 |
| 9,301,603 | B1 | 4/2016 | Koehn et al. | |
| 9,386,847 | B1 * | 7/2016 | Jeffries | A47B 88/417 |
| 10,088,222 | B2 * | 10/2018 | Caglin | F25D 25/02 |
| 2009/0001037 | A1 * | 1/2009 | Wilcock | A47B 96/02 211/119.003 |
| 2011/0025181 | A1 * | 2/2011 | Vinke | A47B 67/04 439/577 |
| 2019/0038021 | A1 * | 2/2019 | Penna Costa | F16B 12/08 |
| 2022/0265043 | A1 * | 8/2022 | Rummery | A47B 45/00 |

FOREIGN PATENT DOCUMENTS

| | | | | |
|---|---|---|---|---|
| CN | 214283916 | U | 9/2021 | |
| DE | 102015103661 | B4 * | 8/2021 | B65G 1/02 |
| EP | 2430947 | A1 * | 3/2012 | A47B 47/06 |
| JP | 4372899 | B2 | 11/2009 | |
| JP | 2016106645 | A * | 6/2016 | A47B 47/00 |
| WO | WO-2020212838 | A1 * | 10/2020 | A47B 57/20 |

* cited by examiner

CABINET SYSTEM

TECHNICAL FIELD

The description generally relates to a cabinet system. More specifically, embodiments of the present invention relate to a cabinet system with a removable shelf.

BACKGROUND

Storage containers typically have shelves for storing and organizing items placed into the storage container.

BRIEF DESCRIPTION

In one aspect, the disclosure relates to a cabinet system comprising: a cabinet defined by a back panel, top panel, bottom panel and first and second opposing side panels; at least one slot on each of the first and second side panels for supporting at least one removable shelf; and the at least one removable shelf comprising a cut-out along a rear edge of the shelf wherein the cut-out is configured to weaken the at least one removable shelf at a predetermined location to promote controlled deformation of the shelf.

In another aspect, the disclosure relates to a cabinet system comprising: a cabinet defined by a back panel, top panel, bottom panel and first and second opposing side panels; at least one removable shelf comprising a top surface supported by a frame having first and second opposing sides with each of the first and second opposing sides having a front tab and a rear tab; and a front slot positioned near a front edge and a rear slot positioned near a rear edge of one of the first or second side panels, wherein the front slot has a different size than the rear slot.

DETAILED DESCRIPTION

Figure 1:
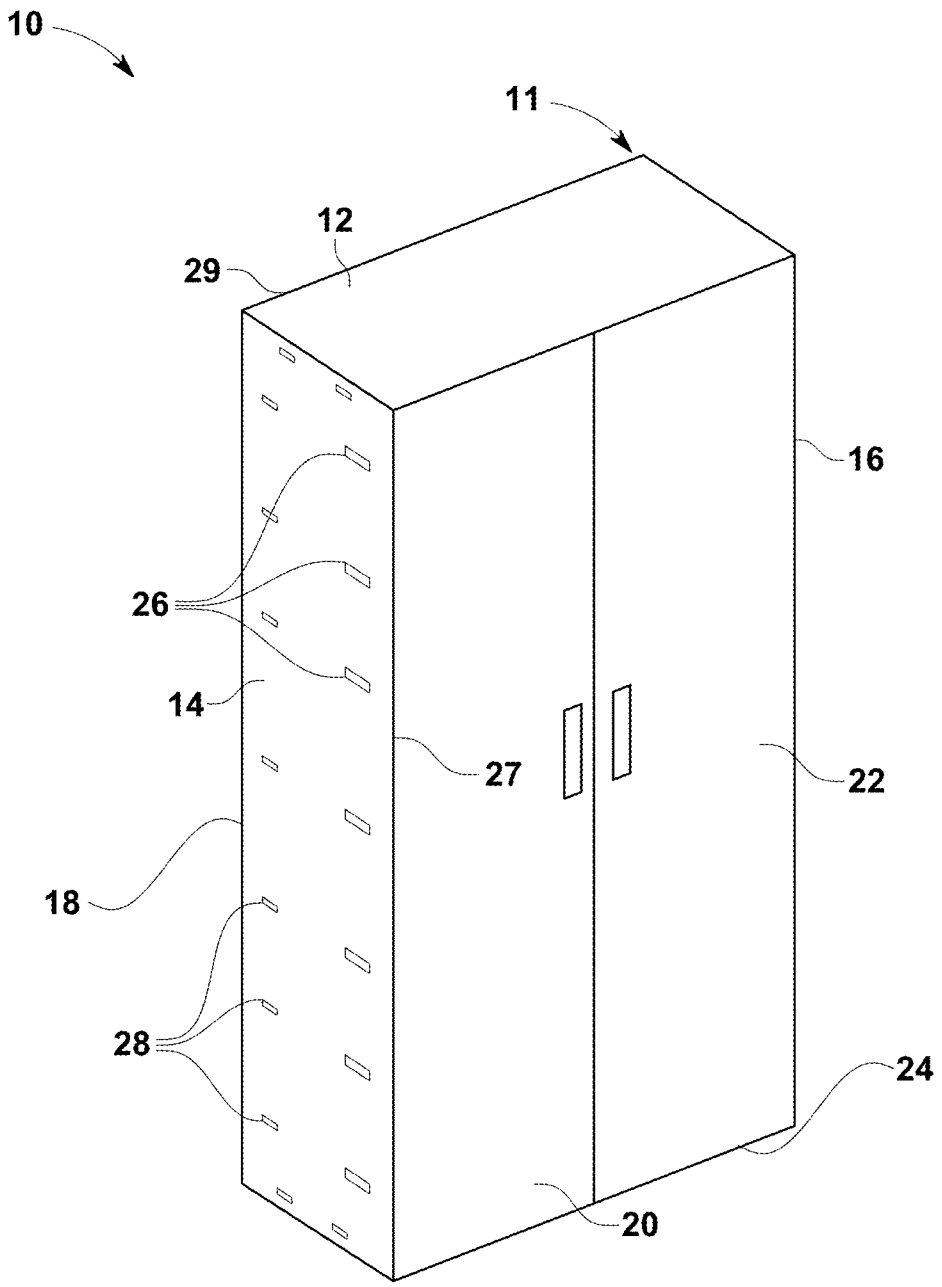
FIG. 1 is a perspective view of a cabinet system.

Features, advantages, and aspects of the present disclosure are set forth or apparent from a consideration of the following detailed description, drawings, and claims. Moreover, the following detailed description is exemplary and intended to provide explanation without limiting the scope of the disclosure as claimed.

As used herein, the terms "first," "second," or the like can be used interchangeably to distinguish one component from another and are not intended to signify location or importance of the individual components. In addition, the singular forms "a," "an," and "the" include plural references unless the context clearly dictates otherwise.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

All directional references (e.g., top, bottom, vertical, horizontal, etc.) are only used for identification purposes to aid the reader's understanding of the present disclosure, and do not create limitations, particularly as to the position, orientation, or use of aspects of the disclosure described herein. Connection references (e.g., attached, coupled, fastened, and connected) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Cabinet systems, including freestanding cabinets and wall-mounted cabinets, typically include shelves configured to store and support items within an interior of the cabinet. The shelves can be a combination of removable shelves and fixed shelves. A user may be required to assemble the storage cabinet system or the storage cabinet system can be adjustable, meaning the user can mount a various number of removable shelves at varying heights to configure the cabinet system for the user's specific storage needs. In some instances, during assembly, a user may mount tabs of the removable shelves in the wrong orientation. Thus, it has been determined that it would be beneficial for the removable shelves to have a configuration that orients the shelf in the cabinet. For example, the front and rear of the shelf can be configured differently such as including front and rear tabs, where the front tabs are a different size than the rear tabs. This configuration acts as a poka-yoke feature and prevents the front tabs and the rear tabs from mounting in the wrong slots. In addition, the smaller rear tabs contribute to controlling the deformation of the removable shelf towards the back panel of the cabinet.

In other instances, even when the shelf is installed correctly, one or more of the removable shelves may experience an overload condition when a user places a predetermined load on a shelf. Thus, it has been determined that it would be beneficial to include a cut-out along the removeable shelf. The cut-out is configured to weaken the removable shelf at a predetermined location to promote controlled deformation of the shelf. The predetermined location can be located at the rear edge of the removable shelf, to promote controlled deformation near the back of the cabinet, away from a front edge of the cabinet.

FIG. 1 illustrates that a cabinet system 10 can be configured as a storage cabinet in a non-limiting example. Further non-limiting examples include a storage box or any other type of container that can be used for storing items. A cabinet 11 is defined by a top panel 12, a first side panel 14, a second side panel 16 opposing the first side panel 14, a back panel 18, a set of door panels 20 and 22, and a bottom panel 24. It is contemplated in a non-limiting example that the set of door panels 20 and 22 may not be utilized and the cabinet may include open shelving.

At least one slot is included on each of the first side panel 14 and the second side panel 16. In the illustrated example, the at least one slot comprises two slots, a front slot 26 positioned near a front edge 27 and a rear slot 28 positioned near a rear edge 29 of at least one of the first side panel 14 or second side panel 16. The front slot 26 and the rear slot 28 can be an inward facing slot or a through-hole in non-limiting examples. The front slots 26 and the rear slots 28 have been illustrated as openings for clarity.

Figure 2:
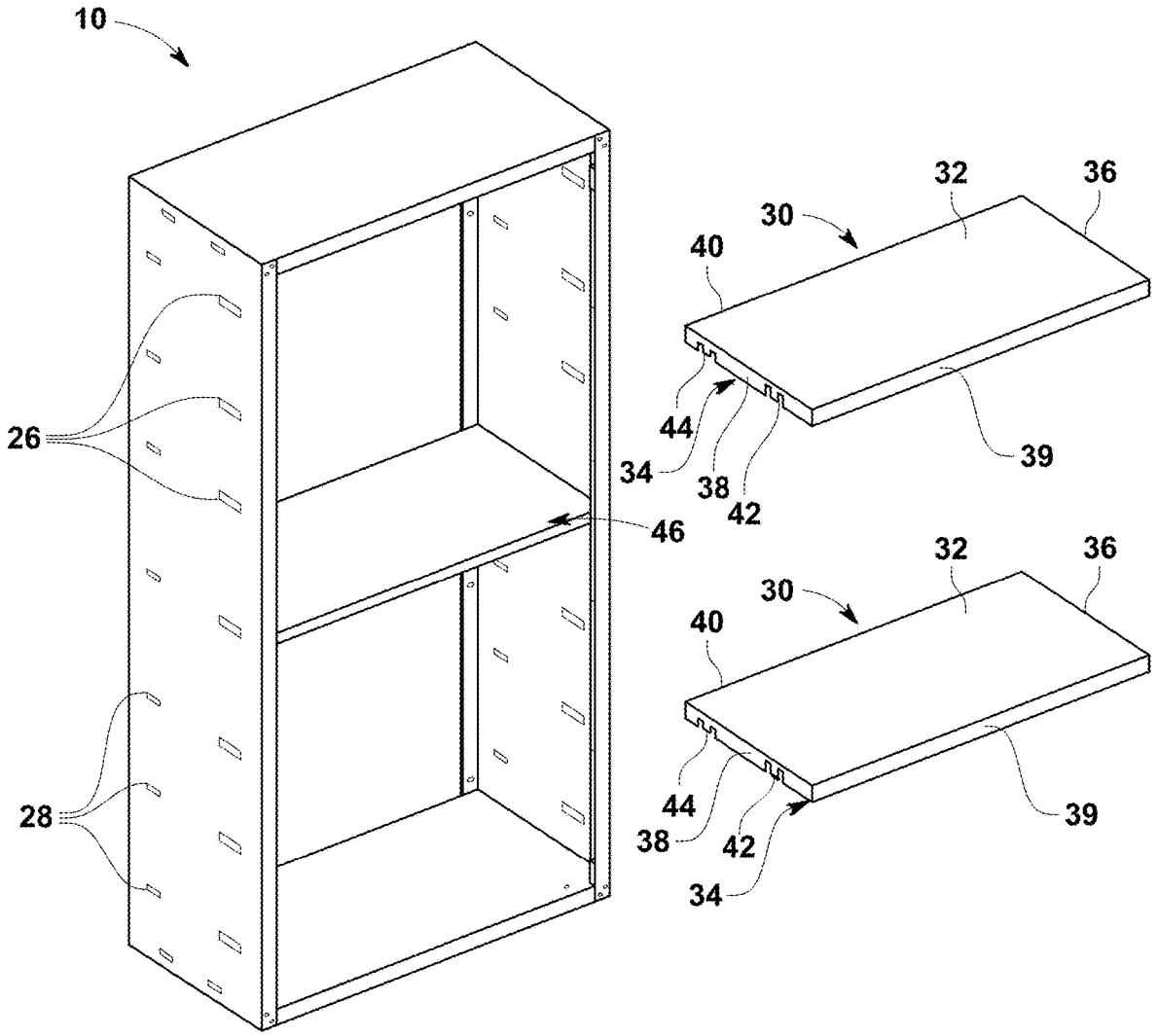
FIG. 2 is a perspective view of a cabinet system with doors removed.

The front slots 26 and the rear slots 28 are configured to support at least one removable shelf 30, which is described further in FIG. 2. FIG. 2 is a perspective view of the cabinet system 10 with the door panels 20 and 22 and any mounting assemblies therefore removed for visual clarity. In the example shown, the front slots 26 and the rear slots 28 of the first side panel 14 are spaced from but correspond with the front slots 26 and the rear slots 28 of the second side panel 16. That is, the front slots 26 of the first side panel 14 are substantially aligned the front slots 26 of the second side panel 16. Similarly, the rear slots 28 of the first side panel 14 are substantially aligned to the rear slots 28 of the second side panel 16.

A top surface 32 of the at least one removable shelf 30, herein removable shelf or removable shelves, is supported by a frame 34 extending around the periphery of the top surface 32. The frame 34 has a first side 36, a second side 38, a front side 39, and a rear side 40. The first side 36 opposes the second side 38. That is, the first side 36 and the second side 38 are opposing side panels. The removable shelf 30 is substantially rectangular, though that need not be the case. In the non-limiting example shown, two removable shelves 30 are shown exploded from the cabinet 11.

A front tab 42 is provided near a front portion on the first side 36 and the second side 38 of the removable shelves 30. A rear tab 44 is provided near a rear portion on the first side 36 and the second side 38 of the removable shelves 30. While the tabs on the second side 38 can be seen in FIG. 2 it will be understood that they are similar to those on the first side 36. In the non-limiting example shown, each removable shelf 30 includes two tabs on each of the first side 36 and the second side 38, a front tab 42 and a rear tab 44, however that need not be the case. It is contemplated that the removable shelf 30 can have any number of tabs, for example, a front tab, an intermediate tab, and a rear tab. By way of further example, the removable shelf 30 can include a single tab. The front tab 42 and the rear tab 44 of the first side 36 are configured to couple with the corresponding front slot 26 and rear slot 28 of the first side panel 14. The front tab 42 and the rear tab 44 of the second side 38 are configured to couple with the corresponding front slot 26 and rear slot 28 of the second side panel. That is, each of the first side 36 and the second side 38 has at least one tab for engaging the at least one slot. Further, the front tab 42 on the first side 36 aligns with at least one of the front slots 26 on the first side panel 14. The front tab 42 on the second side 38 aligns with at least one rear tab 44 on the second side panel 16. The rear tab 44 on the first side 36 and the second side 38 align with the rear slots 28 on the first side panel 14 and the second side panel 16.

A fixed shelf 46 can be fixedly disposed within the cabinet system 10. The fixed shelf 46 is configured to provide support and stability to the first side panel 14, the second side panel 16, the back panel 18, and the door panels 20 and 22. While illustrated as having one fixed shelf 46, any number of fixed shelves 46 are contemplated. Additionally or alternatively, all of the shelves can be removable shelves 30 in such an instance the fixed shelf 46 (may not be utilized. In a non-limiting example, three removable shelves 30 can be included in the cabinet 11. It will be understood that any number of shelves are contemplated, including one.

Figure 3:
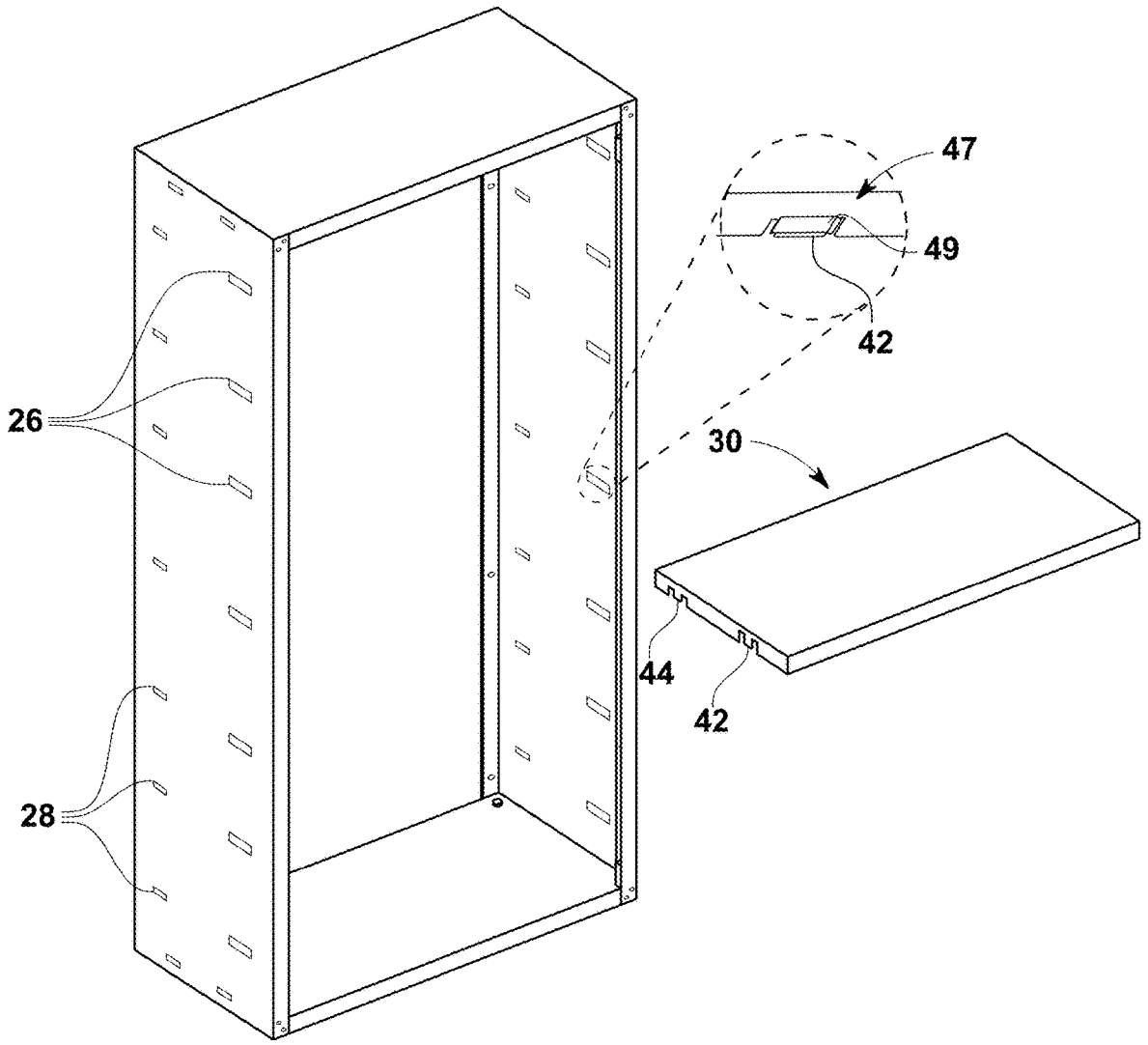
FIG. 3 is a perspective view of a cabinet system of FIG. 2 with at least one removable shelf exploded.

FIG. 3 is a perspective view of the cabinet 11 showing no shelfs installed for clarity. Another example of a slot is illustrated. The slot can be formed parallel to the first side panel 14 or second side panel 16. The enlarged portion of FIG. 3 better illustrates that the slot can be formed via a bracket or catch 47 spaced or otherwise extending from an interior of the first side panel 14 or the second side panel 16. A receiving portion 49 of the catch 47 extends inward from the interior of the first side panel 14 or the second side panel 16. The receiving portion 49 is configured to receive the front tab 42 or the rear tab 44. In the non-limiting example shown, the front tab 42 is hooked onto or engaged with the catch 47. That is, the front tab 42 or the rear tab 44 can hook into the catch 47. While the slots in the cabinet 11 are illustrated generically as openings it will be understood that the bracket formed slot can be included for any set of slots, can be included for any single slot, can be utilized in combination with other types of slots, etc.

Figure 4:
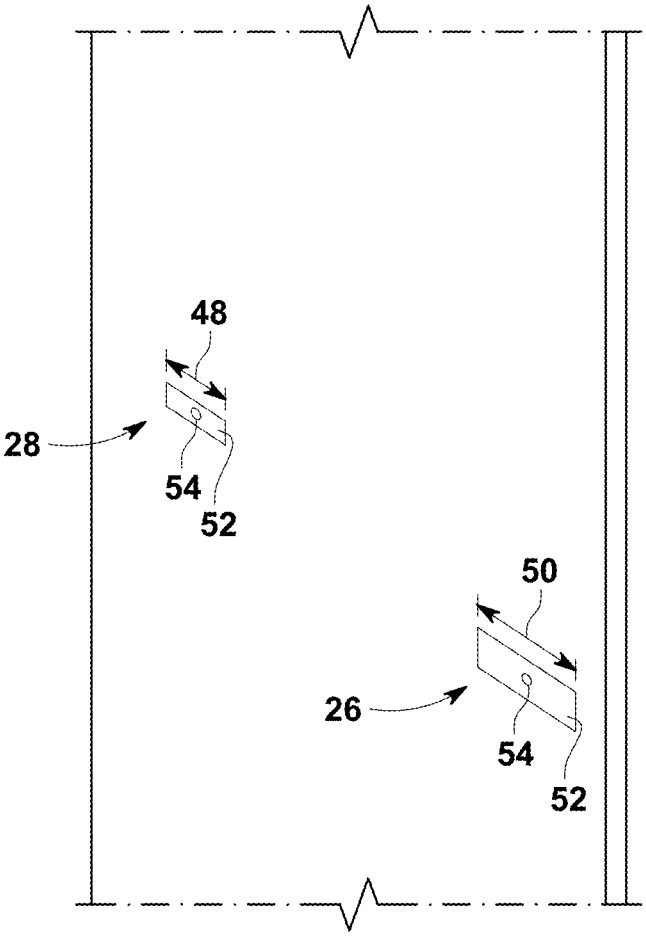
FIG. 4 are side views of a front slot and a rear slot of FIG. 2 and FIG. 3.

FIG. 4 is an enlarged view of the front slot 26 and the rear slot 28 of FIG. 2 and FIG. 3. In the non-limiting example shown, the front slot 26 and the rear slot 28 are inwardly facing slots. That is, at least a portion of the first side panel 14 or the second side panel 16 form an inward facing slot to define a receiving portion 52 in which the front tab 42 (FIG. 2 and FIG. 3) or the rear tab 44 (FIG. 2 and FIG. 3) can be retained or otherwise mount thereto. More specifically for the rear slot 28 the receiving portion 52 is formed by a body having a rear length 48 that can extend to define a width of the rear slot 28. The rear length 48 is configured to accommodate the front tab 42 (FIG. 2 and FIG. 3). By way of further non-limiting example, for the front slot 26 the receiving portion is formed by a body having a front length 50 defining a width of the front slot 26. The front length 50 is configured to accommodate the front tab 42 (FIG. 2 and FIG. 3). The front length 50 is larger than the rear length 48. That is, the front slot 26 has a different length than the rear slot 28 to define a poka-yoke. However, it is contemplated that the rear length could alternatively be larger than the front length.

A fastener opening 54 is centrally located on the receiving portion of the front slot 26 and the rear slot 28. It will be understood that any suitable type of fastener can be received therein. By way of non-limiting examples, such a fastener can include a screw, bolt, snap, or any suitable form of fastener. For example, the fastener can also be a spring-loaded mechanism. The fastener can be inserted through the fastener opening 54 and be configured to selectively fasten one or both of the front tab 42 (FIG. 2 and FIG. 3) and the rear tab 44 (FIG. 2 and FIG. 3) to the front slot 26 and the rear slot 28. The front tab 42, the rear tab 44, or a combination thereof can also include a fastener opening but need not. It will be understood that a fastener opening could be formed during the fastening.

Figure 5:
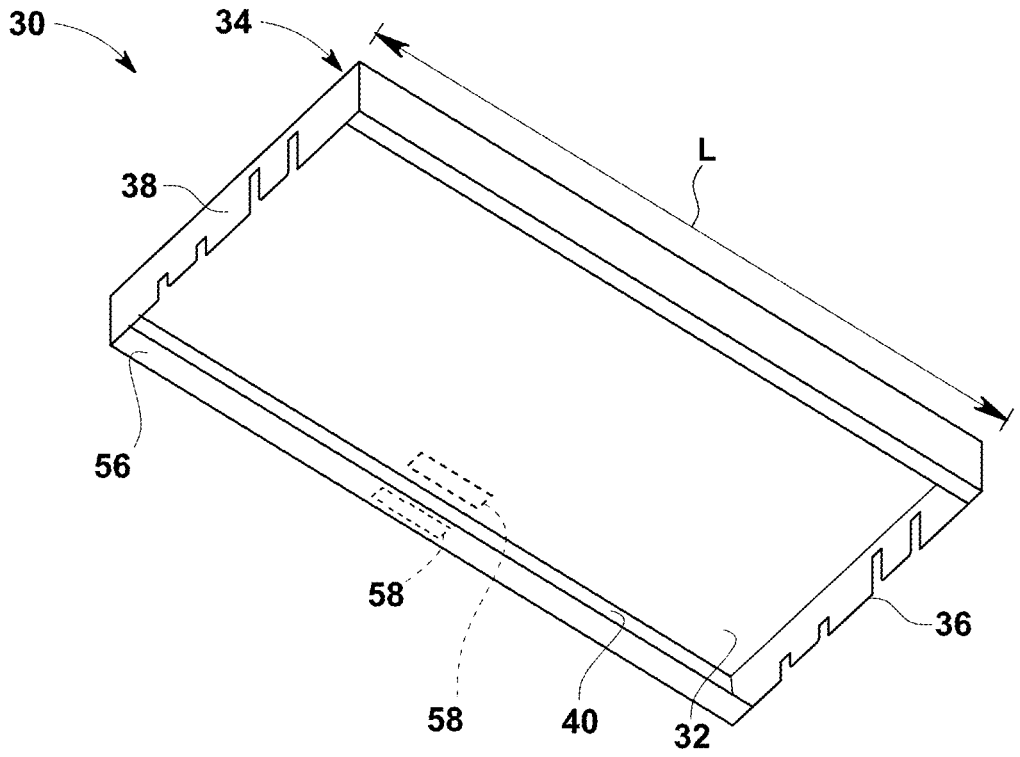
FIG. 5 is a perspective view of the removable shelf.

FIG. 5 is a perspective view of the removable shelf 30 of FIG. 2 and FIG. 3. Optionally, one or more cut-outs 58 are located along a rear edge 56 of the removable shelf 30 wherein the one or more cut-outs 58 are configured to weaken the at least one removable shelf 30 at predetermined locations to promote controlled deformation of the removable shelf 30. By way of non-limiting example, a length of the cut-out 58 is at most ¼ a length L of the at least one removable shelf 30. In the non-limiting example shown, the one or more cut-outs 58 are optionally centered along the rear edge 56 and further located on the rear side 40. In another example, the cut-out 58 is optionally positioned on the top surface 32, however, this need not be the case. The one or more cut-outs 58 are shown as a substantially rectangular through-hole cut-out, however any suitable shape and form are contemplated.

Figure 6:
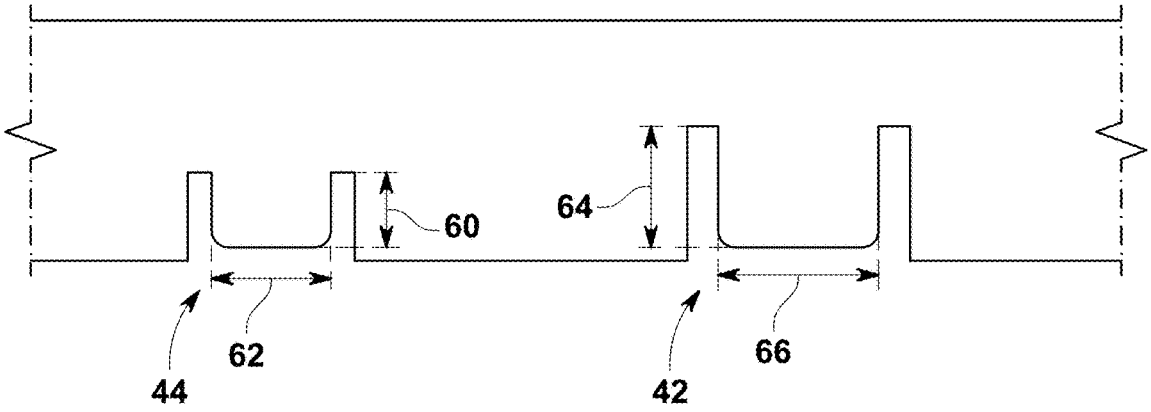
FIG. 6 is a side view of a portion of the removable shelf.

FIG. 6 is an enlarged side view of the removable shelf 30. The rear tab 44 has a rear tab surface area. More specifically, the rear tab 44 is illustrated as being generally rectangular and having a rear tab length 60 and a rear tab width 62 that define the rear tab surface area. Similarly, the front tab 42 has a front tab surface area. The front tab 42 is also illustrated as being generally rectangular and having a front tab length 64 and a front tab width 66 that define the front tab surface area. In the non-limiting example shown, the front tab surface area is different than the rear tab surface area. Further, the front tab surface area is larger than the rear tab surface area. That is, the front tab 42 is larger than the rear tab 44. Further still, both the front tab 42 and the rear tab 44 have rounded edges although that need not be the case.

Figure 7:
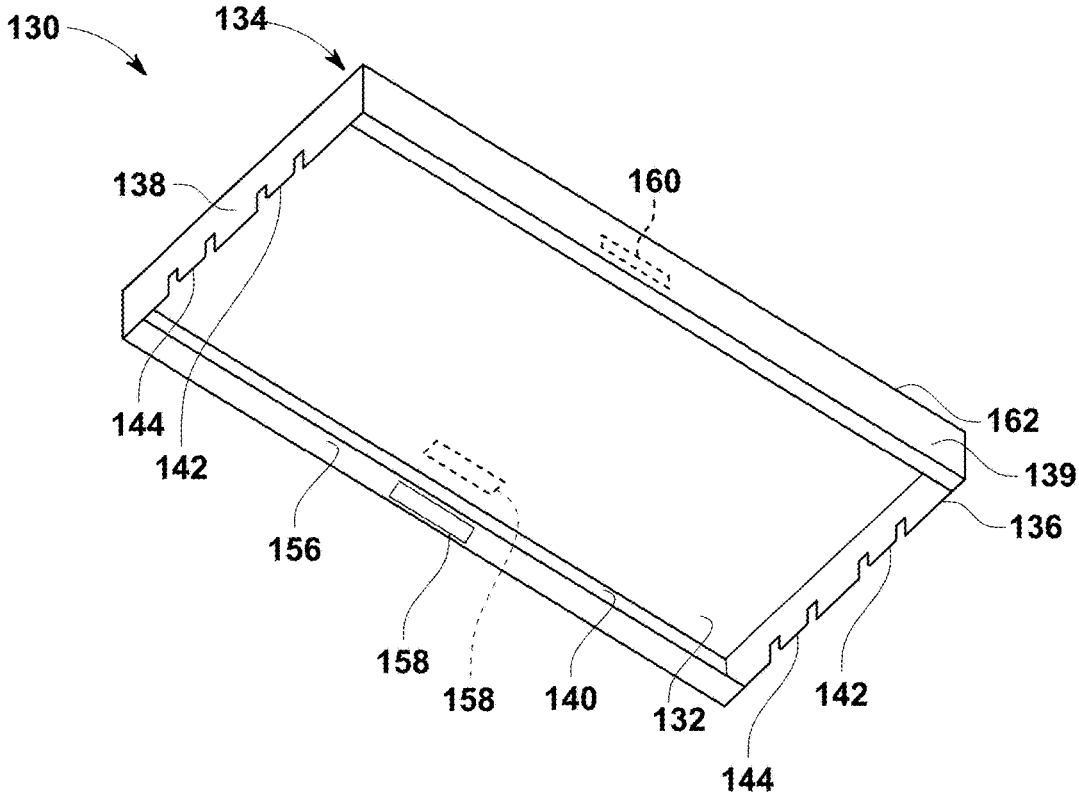
FIG. 7 is a perspective view of a removable shelf that may be utilized in the cabinet system of FIG. 1.

FIG. 7 is a perspective view of a removable shelf 130 that can also be utilized in the cabinet 11. The removable shelf is similar to the removable shelf 30 and like numbers increased by 100 will be utilized with it being understood that the description of like parts will apply to the removable shelf 130 unless otherwise described. Similar to FIG. 5, a top surface 132 of the removable shelf 130 is supported by a frame 134 extending around the periphery of the top surface 132. The frame 134 has a first side 136, a second side 138, a front side 139, and a rear side 140. The first side 136 opposes the second side 138.

A front tab 142 is provided on both the first side 136 and the second side 138 of the removable shelf 130. A rear tab 144 is provided on both the first side 136 and the second side 138 of the removable shelf 130. In the non-limiting example shown, the front tab 142 has a same size as the rear tab 144. That is, a surface area of the front tab 142 is the same as a surface area of the rear tab 144. Further, while a front tab 142 and a rear tab 144 are shown on each side that need not be the case. It is contemplated that the removable shelf 130 can have any number of tabs, for example, a front tab, an intermediate tab, and a rear tab. The front tab 142 and the rear tab 144 are configured to couple with corresponding front slots 26 (FIG. 1-3) and the rear slots 28 (FIG. 1-3). That is, each of the first side 136 and the second side 138 has at least one tab for engaging at least one slot.

A cut-out 158 is positioned along a rear edge 156 on the rear side 140. The cut-out 158 is configured to weaken the removable shelf 130 at a predetermined location to promote controlled deformation of the removable shelf 130. Optionally, the cut-out 158 can be positioned along the rear edge 156 located on the top surface 132. Further, a second cut-out 160 positioned near a front edge 162 on the frame 134 for engaging the set of door panels. More specifically, the second cut-out 160 is centered along the front edge 162 and located on the front side 139 of the frame 134. The second cut-out 160 is configured to engage the set of door panels 20, 22 (FIG. 1). In a non-limiting example, the second cut-out 160 is configured to engage a latch mechanism of the set of door panels 20, 22 (FIG. 1).

Referring to FIGS. 1-6, during operation, the cabinet system 10 can be assembled or shelfing height can be adjusted by a user. The cabinet system 10 has at least one removable shelf 30 which can be installed at various heights according to the user's desired storage configuration. During assembly or adjustment of the removable shelf 30, the front tabs 42 engage with the front slots 26. The rear tabs 44 engage with the rear slots 28 parallel to the front slots. In this manner, the user inserts the removable shelf 30 into the corresponding slots and the removable shelf 30 is supported by the front slots 26 and the rear slots 28 within the cabinet 11. The front tabs 42 are larger than the rear tabs 44 and the front slots 26 are larger than the rear slots 28. This configuration ensures that the removable shelf 30 is only inserted in the correct orientation. If a user were to attempt to install the removable shelf 30 in the wrong orientation, the front tabs 42 would align with the rear slots 28; however, because the front tabs 42 are larger they would not fit in the rears slots 28. Thus, due to the size difference between the front tabs 42 and the rear tabs 44, as well as the front slots 26 and the rear slots 28, the removable shelf 30 cannot be inserted into the slots in this orientation. This would prompt the user to re-orient the removable shelf 30 such that the front tabs 42 align with the front slots 26 and that the rear tabs 44 align with the rear slots 28 properly orienting the removable shelf 30.

Referring to FIGS. 1-7 during operation, the cabinet system 10 may become loaded with a plurality of items, causing an overload condition. The cut-outs 58, 158 at the rear edge 56, 156 of the removable shelf 30, 130 causes the removable shelf 30, 130 to weaken at the rear edge 56, 156 to promote controlled deformation of the removable shelf 30, 130. This controlled deformation causes the plurality of items on the removable shelf 30, 130 to move towards the back panel 18 of the cabinet 11 away from a user that may be standing in front of the cabinet system 10.

Aspects of the disclosure provide for several benefits. One is that the differing sizes of the front tabs and the rear tabs allow the user to insert the removable shelf in only one orientation. This feature acts as a poka-yoke, ensuring the user installs the removable shelf correctly within the cabinet. Further, the cut-out along the rear edge of the removable shelf is configured to control the deformation of removable shelf to the back of the removable shelf in the event of an overload condition. This controlled deformation causes items on the removable shelf to shift towards the back panel of the cabinet away from the front of the cabinet. An additional benefit of the differing sizes of the front tabs and the rear tabs is that the rear tabs being smaller than the front tabs. The smaller rear tabs contribute to controlling the deformation of the removable shelf towards the back panel of the cabinet.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Moreover, while "a set of" or "a plurality of" various elements have been described, it will be understood that "a set" or "a plurality" can include any number of the respective elements, including only one element. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. The patentable scope of the disclosure is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects of the disclosure are provided by the following clauses:

A cabinet system comprising: a cabinet defined by a back panel, top panel, bottom panel and first and second opposing side panels; at least one slot on each of the first and second side panels for supporting at least one removable shelf; and the at least one removable shelf comprising a cut-out along a rear edge wherein the cut-out is configured to weaken the at least one removable shelf at a predetermined location to promote controlled deformation of the removable shelf.

The cabinet system of any preceding clause, wherein the cut-out is centered along the rear edge of the at least one removable shelf.

The cabinet system of any preceding clause, wherein a length of the cut-out is at most ¼ a length of the at least one removable shelf.

The cabinet system of any preceding clause, wherein the at least one removable shelf comprises a top surface supported by a frame extending around a periphery of the top surface.

The cabinet system of any preceding clause, wherein the frame has first and second opposing sides with each of the first and second opposing sides having at least one tab for engaging the at least one slot.

The cabinet system of any preceding clause, wherein each of the at least one tab comprises two tabs, a front tab positioned near a front portion of the shelf and a rear tab positioned near a rear portion of the shelf for engaging the at least one slot on one of the first and second side panels.

The cabinet system of any preceding clause, wherein the front tab has a different size than the rear tab.

The cabinet system of any preceding clause, wherein the front tab has a same size as the rear tab.

The cabinet system of any preceding clause, wherein the at least one slot comprises two slots, a front slot positioned near a front edge and a rear slot positioned near a rear edge of one of the first or second side panels.

The cabinet system of any preceding clause, wherein the front slot has a different length than the rear slot.

A cabinet system comprising: a cabinet defined by a back panel, top panel, bottom panel and first and second opposing side panels; at least one removable shelf comprising a top surface supported by a frame having first and second opposing sides with each of the first and second opposing sides having a front tab and a rear tab; and a front slot positioned near a front edge and a rear slot positioned near a rear edge of one of the first or second side panels, wherein the front slot has a different size than the rear slot to define a poka-yoke.

The cabinet system of any preceding clause, wherein the front tab is positioned near a front portion of the removable shelf and the rear tab is positioned near a rear portion of the removable shelf for engaging the at least one slot on one of the first and second side panels.

The cabinet system of any preceding clause, wherein the front tab is larger than the rear tab.

The cabinet system of any preceding clause, further comprising a cut-out along a rear edge of the at least one removable shelf wherein the cut-out is configured to weaken the at least one removable shelf at a predetermined location to promote controlled deformation of the shelf.

The cabinet system of any preceding clause, wherein the cut-out is centered along the rear edge of the at least one removable shelf.

The cabinet system of any preceding clause, wherein the cut-out is positioned on the top surface.

The cabinet system of any preceding clause, wherein a length of the cut-out is at least ¼ a length of the at least one removable shelf.

The cabinet system of any preceding clause, further comprising a set of door panels.

The cabinet system of any preceding clause, further comprising a second cut-out positioned near the front edge on the frame for engaging the set of door panels.

The cabinet system of any preceding clause, wherein the front slot has a larger length than the rear slot.

What is claimed is:

1. A cabinet system comprising:

a cabinet defined by a back panel, top panel, bottom panel and first and second opposing side panels;

at least one slot on each of the first and second side panels for supporting at least one removable shelf; and the at least one removable shelf comprising a cut-out along a rear edge wherein the cut-out is configured to weaken the at least one removable shelf at a predetermined location to promote controlled deformation of the removable shelf.

2. The cabinet system of claim 1, wherein the cut-out is centered along the rear edge of the at least one removable shelf.

3. The cabinet system of claim 2, wherein a length of the cut-out is at least 1/4 of a length of the at least one removable shelf.

4. The cabinet system of claim 1, wherein the at least one removable shelf comprises a top surface supported by a frame extending around a periphery of the top surface.

5. The cabinet system of claim 4, wherein the frame has first and second opposing sides with each of the first and second opposing sides having at least one tab for engaging the at least one slot.

6. The cabinet system of claim 5, wherein each of the at least one tab comprises two tabs, a front tab positioned near a front portion of the shelf and a rear tab positioned near a rear portion of the shelf for engaging the at least one slot on one of the first and second side panels.

7. The cabinet system of claim 6, wherein the front tab has a different size than the rear tab.

8. The cabinet system of claim 6, wherein the front tab has a same size as the rear tab.

9. The cabinet system of claim 1, wherein the at least one slot comprises two slots, a front slot positioned near a front edge and a rear slot positioned near a rear edge of one of the first or second side panels.

10. The cabinet system of claim 9, wherein the front slot has a different length than the rear slot.

11. A cabinet system comprising:

a cabinet defined by a back panel, top panel, bottom panel and first and second opposing side panels;

at least one removable shelf comprising a top surface supported by a frame having first and second opposing sides with each of the first and second opposing sides having a front tab and a rear tab; and a front slot positioned near a front edge and a rear slot positioned near a rear edge of one of the first or second side panels, wherein the front slot has a different size than the rear slot to define a poka-yoke.

12. The cabinet system of claim 11, wherein the front tab is positioned near a front portion of the removable shelf and the rear tab is positioned near a rear portion of the removable shelf for engaging the at least one slot on one of the first and second side panels.

13. The cabinet system of claim 11, wherein the front tab is larger than the rear tab.

14. The cabinet system of claim 11, further comprising a cut-out along a rear edge of the at least one removable shelf wherein the cut-out is configured to weaken the at least one removable shelf at a predetermined location to promote controlled deformation of the at least one removable shelf.

15. The cabinet system of claim 14, wherein the cut-out is centered along the rear edge of the at least one removable shelf.

16. The cabinet system of claim 14, wherein the cut-out is positioned on the top surface.

17. The cabinet system of claim 14, wherein a length of the cut-out is at most 1/4 of a length of the at least one removable shelf.

18. The cabinet system of claim 11, further comprising a set of door panels.

19. The cabinet system of claim 18, further comprising a cut-out positioned near the front edge on the frame for engaging the set of door panels.

20. The cabinet system of claim 11, wherein the front slot has a larger length than the rear slot.

* * * * *